United States Patent [19]

Takeuchi et al.

[11] Patent Number: 4,744,433

[45] Date of Patent: May 17, 1988

[54] RESERVE TANKS FOR RADIATORS IN WATER-COOLED, THREE- OR FOUR-WHEELED BUGGIES

[75] Inventors: Tsutomu Takeuchi; Masami Yanagishita; Tadanori Horiuchi, all of Wako, Japan

[73] Assignee: Honda Giken Kogyo Kabushiki Kaisha, Tokyo, Japan

[21] Appl. No.: 924,479

[22] Filed: Oct. 29, 1986

[30] Foreign Application Priority Data

Oct. 30, 1985 [JP] Japan ..... 60-167334[U]
Oct. 30, 1985 [JP] Japan ..... 60-167335[U]

[51] Int. Cl.[4] ..... F28D 1/04

[52] U.S. Cl. ..... 180/68.4; 180/68.6; 280/289 R

[58] Field of Search ..... 180/68.4, 68.6; 165/148; 280/289 R

[56] References Cited

U.S. PATENT DOCUMENTS 3,193,041 7/1965 Peras ..... 180/68.4

4,367,793 1/1983 MacIntosh ..... 180/68.2

*Primary Examiner*—Richard A. Bertsch

*Attorney, Agent, or Firm*—Armstrong, Nikaido, Marmelstein & Kubovcik

[57] ABSTRACT

The present invention relates to a reserve tank for a radiator to be mounted on a water-cooled, three- or four-wheeled buggy, which can store therein the given maximum amount of cooling water, even when said buggy is upright erected with the front portion of its body upwards, wherein the reserve tank includes a storing body provided in its upper portion with a water supply inlet at a position closer to the front portion of a buggy body, and a capacity for storing at least the given maximum amount of cooling water is assured within the rear portion of said storing body, further, the storing body includes a side wall having a member recessed to receive a seat rail stay, a front wall having an insertion piece to be fixedly inserted on a hook secured to the seat rail stay, and a rear wall having a bracket to be secured to the seat rail stay.

4 Claims, 4 Drawing Sheets

RESERVE TANKS FOR RADIATORS IN WATER-COOLED, THREE- OR FOUR-WHEELED BUGGIES

FIELD OF THE INVENTION AND RELATED ART STATEMENT

The present invention relates to a reserve tank for supplying a cooling medium to the radiator of a water-cooled, three- or four-wheeled buggy.

Three- or four-wheeled buggies designed to move on rough roads such as sandy, damp or muddy roads and equipped with wider and low-pressure tires are generally broken down into one type carrying an air-cooled engine, and the other type carrying a water-cooled engine in which high-temperature combustion engine cylinders are cooled by circulating water from a radiator so as to improve the cooling efficiency of the cylinders and prevent a decrease in the output of the engine due to prolonged travelling.

As is the case with four-wheeled motorcars, the radiator is connected with a reserve tank for cooling water supply, which is designed in such a manner that, when the cooling water within a circulating path is heated to high temperatures and is expanded, a quantity of cooling water corresponding to the amount of such expansion is recirculated into the reserve tank, and when the cooling water within the circulating path is cooled down, an additional quantity of fresh cooling water is supplied from the reserve tank, for the purpose of stable supply of cooling water and maintenance over a long period.

To make the most effective use of an available space during transportation or prolonged storage, this type of buggy has been laid with the front and rear portions of its body up and down, respectively.

Therefore, there has been a fear that cooling water stored within the aforesaid reserve tank may leak through a water supply inlet laid sideways, since that tank is laid sideways where the buggy body is upright set up.

Due to the fact that a number of various parts and accessories are to be housed within a body frame, difficulty has been encountered in the arrangement of the reserve tank. In the prior art, since the tank has been interposed between these various parts and accessories, the maintenance of the reserve tank has also been difficult.

OBJECT AND SUMMARY OF THE INVENTION

The present invention has been accomplished in view of the foregoing considerations, and has for its object to provide a reserve tank which can assure that a given amount of cooling water is constantly stored with no fear of leakage of cooling water through a water supply inlet, even when a buggy body is erected with the tank storing the given maximum amount of cooling water.

Another object of the present invention is to provide a reserve tank which is attached to a seat rail stay located in the rear of a buggy body to improve the efficiency of maintenance work, thereby making a contribution to the weight balance of the body.

The present invention is characterized in that storing body of the reserve tank is provided therein with a water supply inlet at a position closer to the front portion of a buggy body, and a capacity for storing at least the given maximum amount of cooling water is assured within the rear portion of said storing body.

According to the reserve tank thus constructed, even when a buggy is erected with the reserve tank containing the given maximum amount of cooling water being laid sideways, no leakage of cooling water takes place so that a predetermined amount of cooling water can be assured within the tank.

The present invention is further characterized in that said storing body is provided on its side wall with a member recessed to receive the seat rail stay, and that said storing body is formed with an insertion piece to be inserted on a hook fixed to said seat rail stay and a bracket for securing said seat rail stay to said storing body.

With this arrangement, it is possible to attach the reserve tank to the rear portion of the buggy body with no need of mounting it at the central portion of a body frame within which various parts and accessories are housed. Thus, the weight of the buggy body is well-balanced, and a dead space can effectively be used to facilitate maintenance work.

BRIEF DESCRIPTION OF THE DRAWINGS

Many other advantages, features and additional objects of the present invention will become apparent to those skilled in the art upon making reference to the detailed description and the accompanying sheet of the drawings on which one preferred embodiment incorporating the principles of the present invention are shown by way of illustrative examples.

The drawings show one preferred embodiment of the present invention, wherein.

DETAILED DESCRIPTION OF PREFERRED EMBODIMENTS

Figure 1:
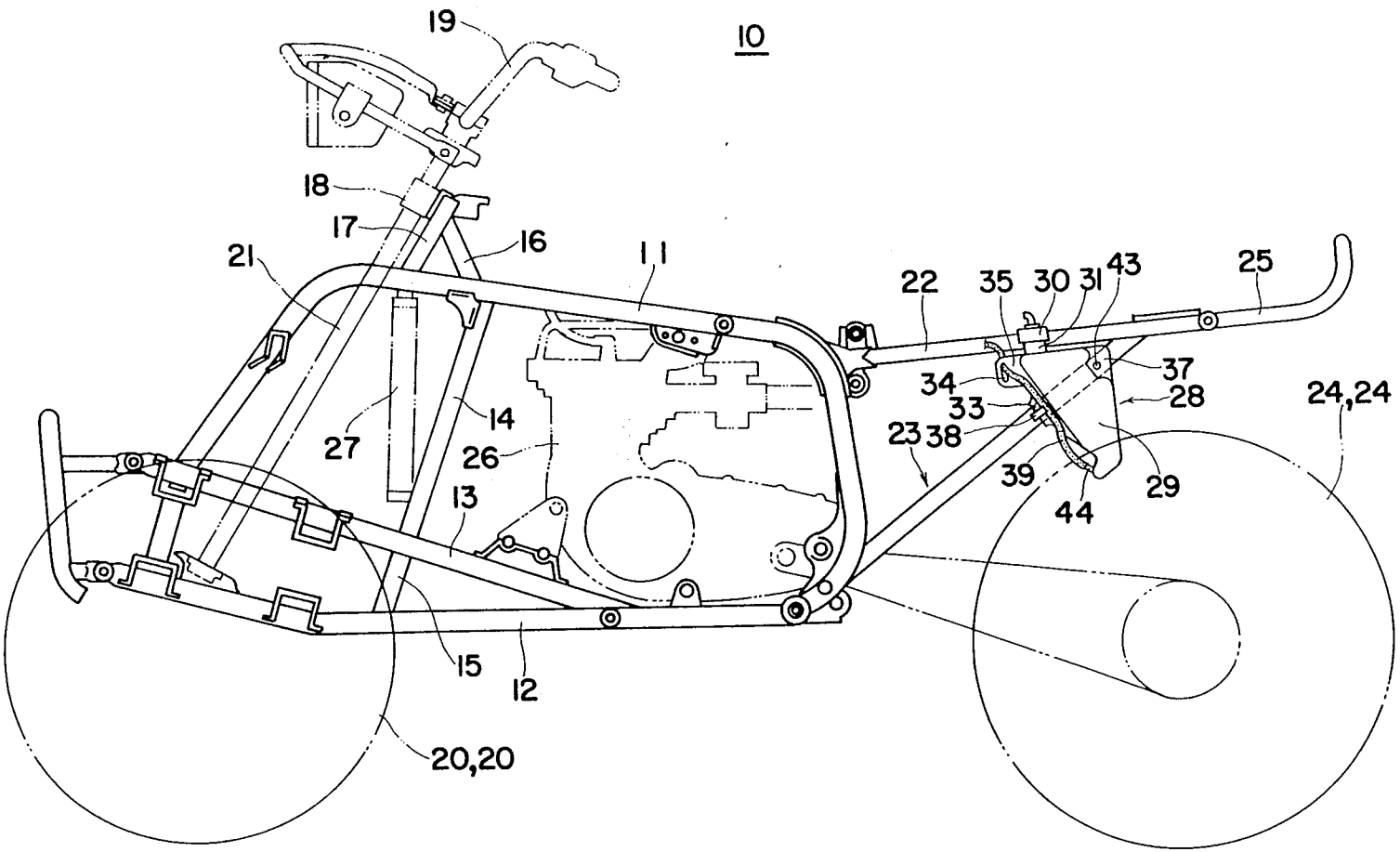
FIG. 1 is a side view of the body frame of a four-wheeled buggy.
Figure 3:
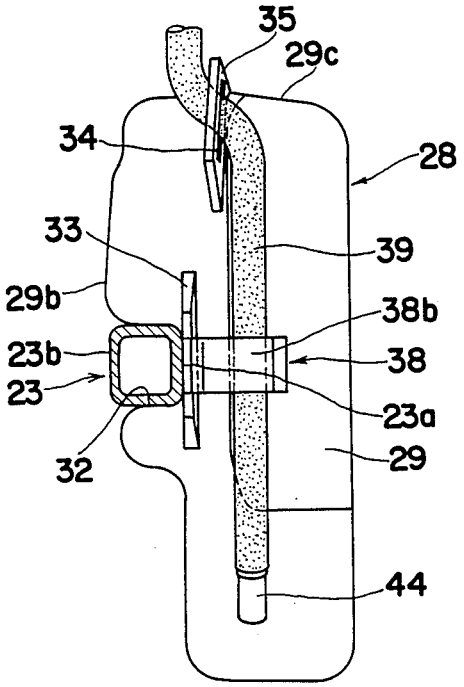
FIG. 3 is a sectional view taken along the line 3—3 of FIG. 2.
Figure 4:
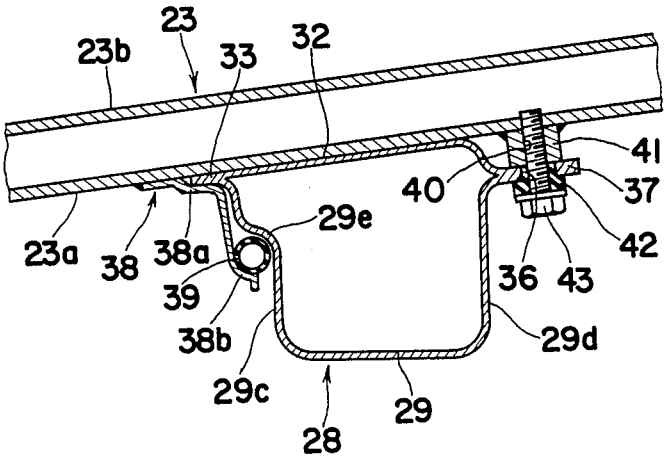
FIG. 4 is a sectional view taken along the line 4—4 of FIG. 2.

FIG. 1 schematically shows a body frame of a four-wheeled buggy generally shown at 10, including a substantially inverted U-shaped main pipe 11 connected at its lower ends with an underpipe 12 and a substay 13 and reinforced at its central portion with longitudinal center pipes 14 and 15 to define a pair of right and left subframes which are, in turn, connected to each other by means of a plurality of cross members.

Above the main pipe 11, there is a head pipe 18 fixed to the front portion of a cross member 17 supported by a stay 16. On the head pipe 18 is rotatably supported a steering shaft 21 for steering front wheels 20 and 20 with the manipulation of a handle bar 19. In the rear of the main pipe 2, a pair of seat rails 22 extend rearwardly, the rear portions of which are supported by means of a pair of seat rails stays 23 extending from the underfaces of said rails 22 in an inclining manner. On both sides of the lower portions of said seat rail stays 23 there are suspended rear wheels 24 and 24, and a carry pipe 25 extends from the rear end of each seat rail 22.

The body frame 10 carries an engine 26 in a space between the main pipe 11 and the underpipe 12, in front of which a radiator 27 is supported by the main pipe 11 and the center pipe 14. On the outer side of the left seat rail stay 23 of the body, there is fixedly provided a reserve tank 28 for cooling water supply.

Figure 2:
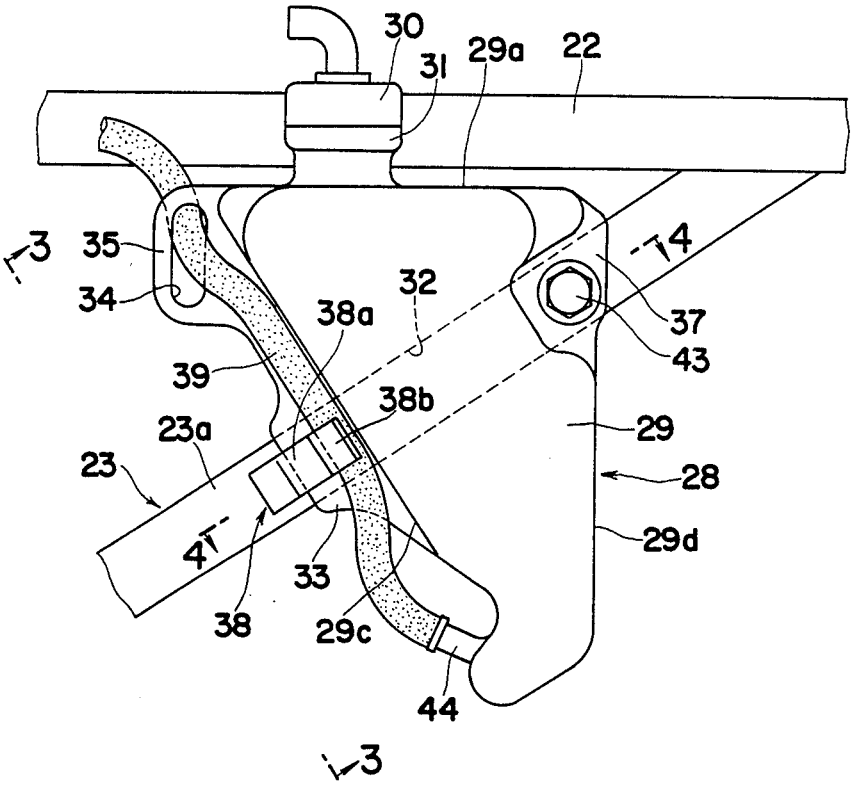
FIG. 2 is a side view of the reserve tank mounted in place.

As illustrated in FIG. 2, the reserve tank 28 includes a storing body 29 of an inverted triangular shape, which has its upper wall 29*a* provided with a water supply inlet 31 into which a tank cap 30 is fitted. As illustrated, the water supply inlet 31 is located at a position of the upper wall that is closer to the front portion of the body. A side wall 29*b* of the storing body 29, positioned within the body, is provided with an obliquely extending member 32 which is recessed to receive seat rail stay 23. A tilting front wall 29*c* of the storing body 29, facing the front portion of the body, is integrally formed with an insertion piece 33 at a position flush with the front end of the member 32 and with a bracket 35 slotted longitudinally at 34. Above a rear wall 29*d* of the storing body 29, there is a bracket 37 at a position flush with the rear end of the member 32, said bracket 37 having a through-hole 36 for attaching the storing body 29 to each seat rail stay 23.

Figure 5:
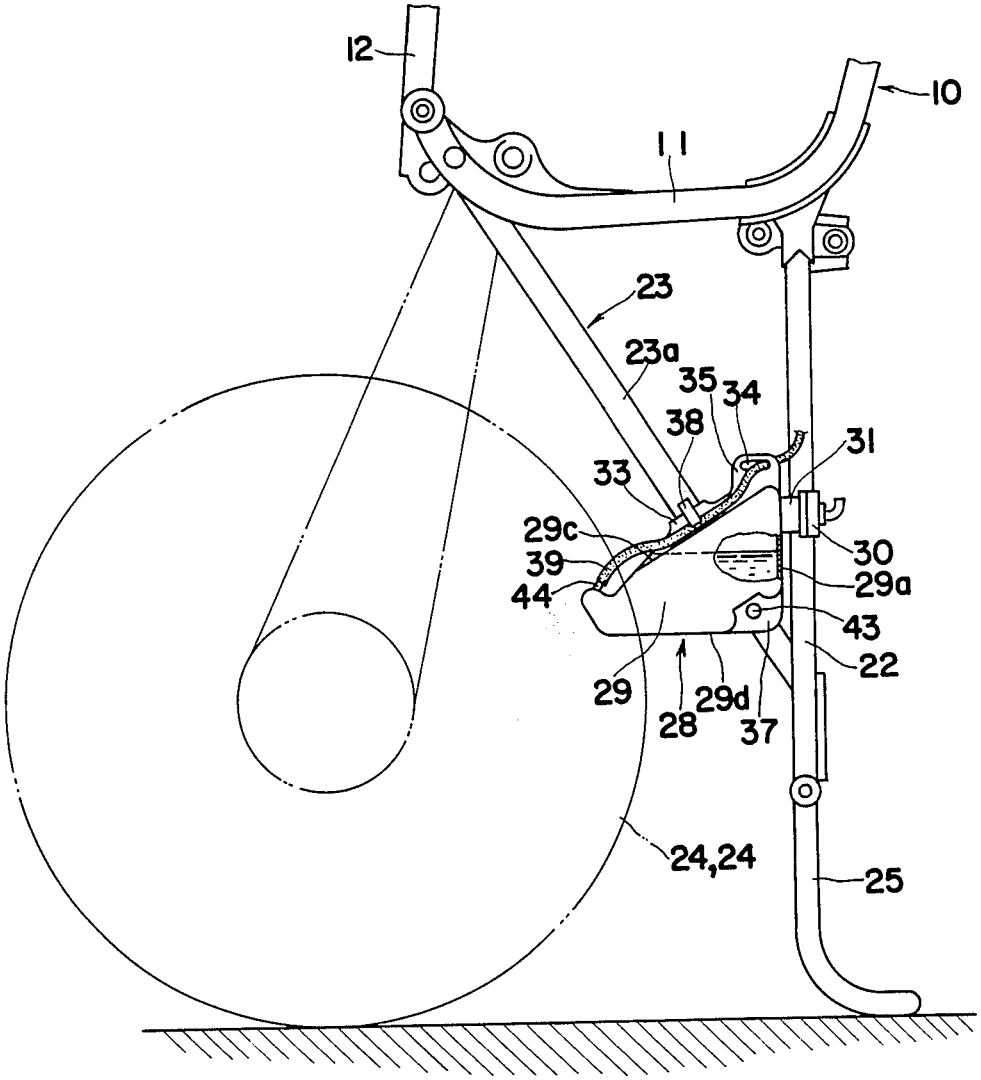
FIG. 5 is a side view illustrating the rear portion of the buggy erected upright for parking or shedding.

The storing body 29 is of an inverted triangular shape, as viewed sideways, and has its front wall 29*c* tilting from its upper front end down to its lower rear end, and thus assures that its portion located on the rear side of the inlet 31 has a capacity larger than the given maximum amount of cooling water. Consequently, even when the buggy is upright erected by the rear wheels 24 and 24 and the carry pipe 25 with the reserve tank 28 laid sideways, as shown in FIG. 5, leakage of cooling water cannot possibly take place, since the water supply inlet 31 is located above the liquid level of cooling water.

On the other hand, the seat rail stay 23 is fixedly provided on its outer side 23*a* with a hook 38 for securing the insertion piece 33 of the reserve tank 24 in place. By bending, the hook 38 is integrally formed of a step portion 38a on which the insertion piece 33 is fixedly inserted and a portion 38*b* for engaging a breezer tube 39 in communication with the radiator 27. In the rear of the hook 38 provided on the outer face 23*a* of the seat rail stay 23, there is fixedly provided a boss 41 having an internally threaded hole 40.

To attach the reserve tank 28 to the seat rail stay 23, the recessed member 32 of the storing body 29 of the reserve tank 28 are first fitted over the stay 23. Then, the insertion piece 33 is inserted on the step portion 38*a* of the hook 38, and a bolt 43 provided with an elastic bushing 42 is inserted into the through-hole 36 in the mounting bracket 37 and into threaded engagement within the internally threaded hole 40 in the boss 41. Further, the breezer tube 39 is inserted through the slot 34 in the bracket 35 and is locked between the engaging portion 38b of the hook 38 and an engaging portion 29*e* formed on the front wall 29*c* of the storing body 29 for connection to a lower connection hole 44 in the storing tank 29.

In accordance with the present invention as described above, the reserve tank 28 is provided with the water supply inlet 31 at a position closer to the front portion of a buggy body, and is formed into an inverted triangular shape so as to allow the storing body 29 located on the rear side of said inlet 31 to have a capacity for storing at least the given maximum amount of cooling water. Thus, even when the buggy body is vertically set up by the rear wheels 24, 24 and carry pipe 25 with the reserve tank laid sideways, as illustrated in FIG. 5, any leakage of cooling water does not occur so that a predetermined amount of cooling water can be stored within the reserve tank 28, since the water supply inlet 31 is positioned above the level of cooling water.

In the embodiment of the present invention as described above, the breezer tube 39 connected with the radiator 27 is supported by means of the slot 34 in the bracket 35, the engaging portion 38b of the hook 38 and the engaging portion 29*b* of the storing body 29, no noticeable rocking movement takes place, even when the buggy travels on rough roads, or is erected for parking or shedding.

It is understood that the reserve tank of the present invention may be formed into suitable shape other than the inverted triangular shape.

It is also understood that, while the foregoing embodiment has been described as attaching the reserve tank 28 to the outer face 23*a* of the seat rail stay 23, it may be mounted on the inner face 23*b* thereof.

Obviously, many modifications and variations of the present invention are possible in the light of the above teachings. It is therefore to be understood that within the scope of the appended claims, the invention may be practiced otherwise than as specifically described.

We claim:

1. A buggy comprising a main body frame, at least one wheel provided at the front of said main body frame, two wheels provided at the rear of said main body frame, an engine installed within said main body frame, a seat rail extending horizontally from an upper rear portion of said main body frame above said rear wheels and a reserve tank connected to said engine, said reserve tank having an inlet at front and upper portion thereof, wherein rear most portion of said seat rail extends to the rear, at least to the plane of the rear most portion of said rear wheels such that said buggy can stand upright by the support of said rear wheels and said rear most portion of said seat rail.

2. A buggy according to claim 1, wherein said reserve tank is formed into a triangular shape having a front wall tilting from its upper front end down to rear lower end thereof.

3. A buggy according to claim 1, wherein said reserve tank includes a side wall having a recess to receive a seat rail stay extending between lower portion of said main body frame and said seat rail, an insertion piece to be inserted into a hook secured to said seat rail stay and a bracket for securing said reserve tank to said seat rail stay.

4. A buggy according to claim 1, wherein said reserve tank includes an engaging portion for holding a breezer tube by said hook of said seat rail stay, said breezer tube being adapted for a radiator of said engine to communicate with said reserve tank and a bracket having a slot through which said breezer tube passes.

* * * * *